US005400534A

United States Patent [19]

Lin

[11] Patent Number: 5,400,534

[45] Date of Patent: Mar. 28, 1995

[54] DECORATION WITH IMPROVED ROTARY RINGS

[76] Inventor: Wen-Pin Lin, No.30, Chien-Yung St., Tung Dist., Taichung City, Taiwan, Prov. of China

[21] Appl. No.: 286,135

[22] Filed: Aug. 4, 1994

[51] Int. Cl.[6] ..... G09F 13/00

[52] U.S. Cl. ..... 40/431; 446/236; 472/7

[58] Field of Search ..... 446/236, 242, 243, 256, 446/265, 241; 40/430, 431, 473, 493, 502, 503; 472/6, 7; 362/35

[56] References Cited

U.S. PATENT DOCUMENTS

| | | | |
|---|---|---|---|
| 3,247,609 | 4/1966 | Hayes et al. | 40/431 |
| 3,594,934 | 7/1971 | Burnbaum | 40/430 |
| 4,141,156 | 2/1979 | Holtvoigt | 40/431 X |
| 4,858,079 | 8/1989 | Ohashi | 446/242 X |

*Primary Examiner*—Mickey Yu

*Attorney, Agent, or Firm*—Christie, Parker & Hale

[57] ABSTRACT

A decoration includes a hollow base assembly, a bulb, a sound generating unit, a motor, a mounting ring fixed on the base assembly, several superposed intermediate rotary rings disposed between the mounting ring and the base, and an upper rotary ring disposed on and above the mounting ring. Any adjacent two of the upper rotary ring, the mounting ring, the intermediate rotary rings and the base have a bearing mechanism which includes several circumferentially spaced-apart ball positioning units, and several balls respectively positioned within the ball positioning units. The balls are confined in the ball positioning units so as to facilitate relative rotation between any adjacent two of the upper rotary ring, the mounting ring, the intermediate rotary rings and the base. When the motor is powered, the upper rotary ring and the intermediate rotary rings rotate relative to the base assembly and the mounting ring.

5 Claims, 8 Drawing Sheets

DECORATION WITH IMPROVED ROTARY RINGS

BACKGROUND OF THE INVENTION

1. Field of the invention

This invention relates to a decoration, more particularly to a decoration which has rotatable rings and which is capable of generating both audio and visual effects.

2. Description of the Related Art

Referring to FIGS. 1 and 2, a conventional decoration has a lower rotary ring 3, an intermediate rotary ring 2 which is disposed rotatably on the lower rotary ring 3 and which carries a frame unit 10*a* thereon, and an upper retaining ring 1 located on the intermediate rotary ring 2. The upper retaining ring 1 is provided with a plurality of gears 6 which mesh respectively with the internal gears of the intermediate rotary ring 2 and the lower rotary ring 3 and which are driven by a motor 7 so as to rotate all of the lower rotary ring 3, the intermediate rotary ring 2 and the frame unit 10*a* relative to the upper retaining ring 1 and a hanging rod 11*a* that is suspended from a ceiling so as to support the rings 1, 2 and 3 thereon. The upper retaining ring 1 further includes a colored plate 8 mounted rotatably on one of the gears 6, a music generating chip 4 disposed inside the upper retaining ring 1, and a bulb 5 positioned under the colored plate 8 within the intermediate rotary ring 2 so as to generate light which passes through the colored plate 8 and which permeates into an optical-fiber piece 9 when the bulb 5 is lighted. Accordingly, it is noted that the driving arrangement among the gears 6, the intermediate rotary ring 2 and the lower rotary ring 3 results in a relatively large operating load for the motor 7, thereby, increasing the power consumption of the latter and causing difficulties in relative rotation between the rings 1, 2 and 3. Furthermore, such a driving arrangement can easily result in wearing of the gears 6.

SUMMARY OF THE INVENTION

Therefore, the main objective of this invention is to provide a decoration which is capable of generating both audio and visual effects and which has several rotatable rings that can easily effect relative rotation therebetween.

According to this invention, a decoration includes a hollow base assembly equipped thereon with a bulb seat, a sound generating unit, and a motor. The bulb seat is disposed on the top end portion of the base assembly and is adapted to be mounted with a bulb thereon so as to generate light. The base assembly further includes a battery chamber formed therein and adapted to receive a battery therein so as to activate the motor, a base having a bottom opening formed in the bottom end portion thereof, a bottom cover mounted removably on the base so as to close the bottom opening, and an upper bearing device disposed on the upper end portion of the base. The bottom cover is removable from the base so as to permit the entry of the battery into the battery chamber. A mounting ring is fixed on and located above the base and has an upper bearing device disposed on the upper end portion of the mounting ring, and a lower bearing device disposed on the lower end portion of the mounting ring. Several superposed intermediate rotary rings are interposed between the base and the mounting ring. Each of the intermediate rotary rings includes an upper bearing device disposed on the upper end portion of the intermediate rotary ring, and a lower bearing device disposed on the lower end portion of the intermediate rotary ring. An upper rotary ring is mounted rotatably and coaxially on and above the mounting ring and includes a lower bearing device disposed on the lower end portion of the upper rotary ring. A light permeable transparent top cover, which rests on the upper end portion of the upper rotary ring so as to close the open top end of the upper rotary ring, can be removable from the upper rotary ring so as to permit the bulb to pass through the upper rotary ring, through the mounting ring and through the intermediate rotary rings, when mounting the bulb on the bulb seat. A gearing includes several horizontal planetary gears disposed rotatably on the base and rotatable by the motor. Each of the upper and intermediate rotary rings includes an internal gear which is formed on the inner surface thereof and which meshes with one of the planetary gears of the gearing. Any adjacent two of the upper rotary ring, the mounting ring, the intermediate rotary rings and the base are interconnected rotatably by the association of one of the upper bearing devices with one of the lower bearing devices. Each of the upper bearing devices and an associated one of the lower bearing devices together constitute a bearing mechanism so as to facilitate relative rotation of any adjacent two of the upper rotary ring, the mounting ring, the intermediate rotary rings and the base. The upper bearing device of each of the mounting ring, the intermediate rotary rings and the base includes a circular upward flange projecting upward from the periphery thereof, several circumferentially spaced-apart ball positioning units disposed along the circular upward flange, and several balls respectively positioned within the ball positioning units. The lower bearing device of each of the upper rotary ring, the mounting ring and the intermediate rotary rings includes a circular downward flange which projects downward from the periphery thereof and which rests on and above the top end portion of a corresponding one of the mounting ring, the intermediate rotary rings and the base. In each of the bearing mechanisms, the balls are confined between the circular downward flange and the ball positioning units so as to facilitate relative rotation between any adjacent two of the upper rotary ring, the mounting ring, the intermediate rotary rings and the base. All of the circular upward and downward flanges are coaxial. When the motor is powered, the upper rotary ring and the intermediate rotary rings rotate relative to the base assembly and the mounting ring.

In an embodiment, each of the ball positioning units of the intermediate rotary rings and the base includes two aligned vertical side ribs and a vertical middle rib which are parallel with each other and which project generally radially from the inner surface of the circular upward flange in such a manner that the middle rib is located between the side ribs. The side ribs have top ends which are at the same level and which are above the top end of the middle rib so as to define a ball accommodating space between the side ribs of each of the positioning units of the intermediate rotary rings and the base and above the corresponding middle rib, thereby resting the balls on the middle ribs of the position unit. Each of the circular downward flanges of the mounting ring and the intermediate rotary rings is located inside a corresponding one of the circular upward flanges of the upper bearing devices in such a manner that the side and middle ribs of a corresponding one of the ball positioning units are located between the circular downward flange and the circular upward flange of a corresponding one of the bearing mechanisms. Each of the side ribs of the ball positioning units has a curved inner surface so as to confine each of the balls between the curved inner surfaces of the side ribs of a corresponding one of the ball positioning units. The mounting ring further includes an auxiliary circular flange which projects upward therefrom and which is radially spaced apart from and coaxial with the circular upward flange of the mounting ring. Each of the ball positioning units of the mounting ring includes two generally radially extending parallel ribs which are spaced apart from each other so as to confine a corresponding one of the balls therebetween and which are between the circular upward flange and the auxiliary circular flange of the mounting ring. The circular downward flange of the upper rotary ring has a bottom end which is located intermediately over the balls of the upper bearing device of the mounting ring so as to prevent removal of the balls of the upper bearing device of the mounting ring from the ball positioning units of the mounting ring.

BRIEF DESCRIPTION OF THE DRAWINGS

Other features and advantages of this invention will become apparent in the following detailed description of the preferred embodiment of this invention with reference to the accompanying drawings, in which.

DETAILED DESCRIPTION OF THE PREFERRED EMBODIMENT

Figure 1:
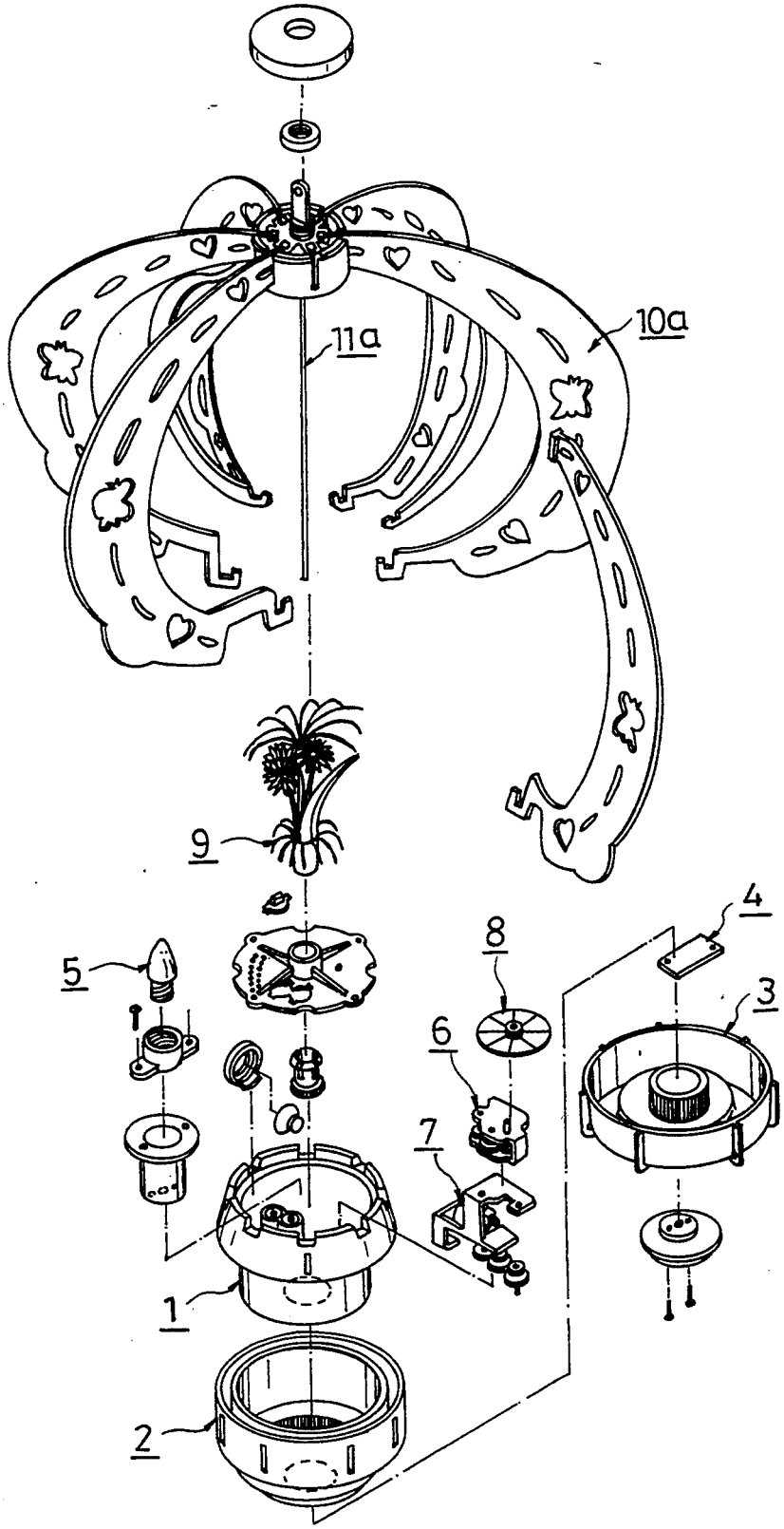
FIG. 1 PRIOR ART
FIG. 1 is an exploded view of a conventional decoration.
Figure 2:
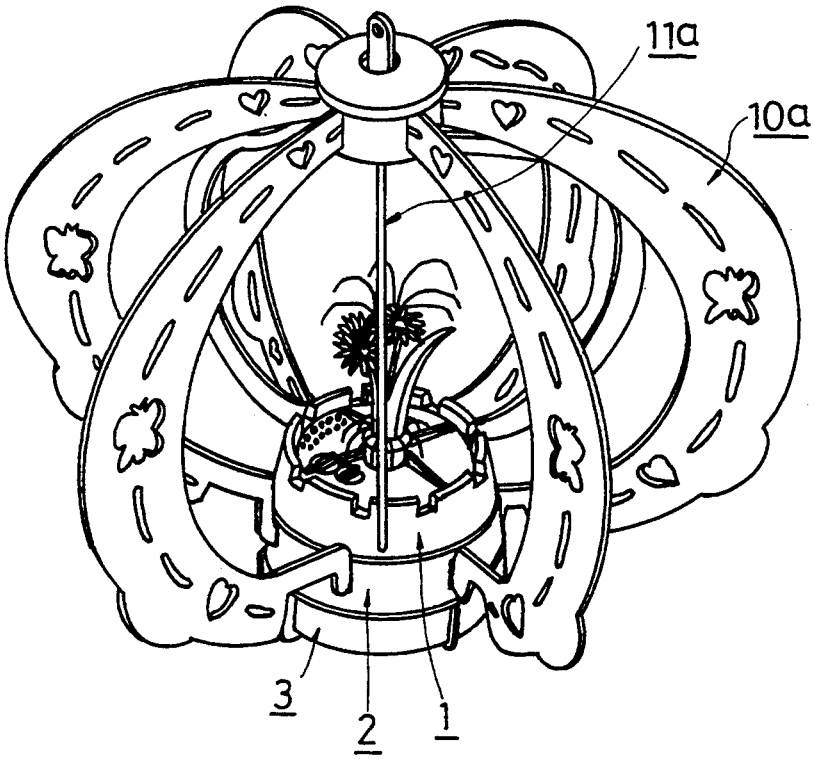
FIG. 2 PRIOR ART
FIG. 2 is a perspective view illustrating the conventional decoration.
Figure 3:
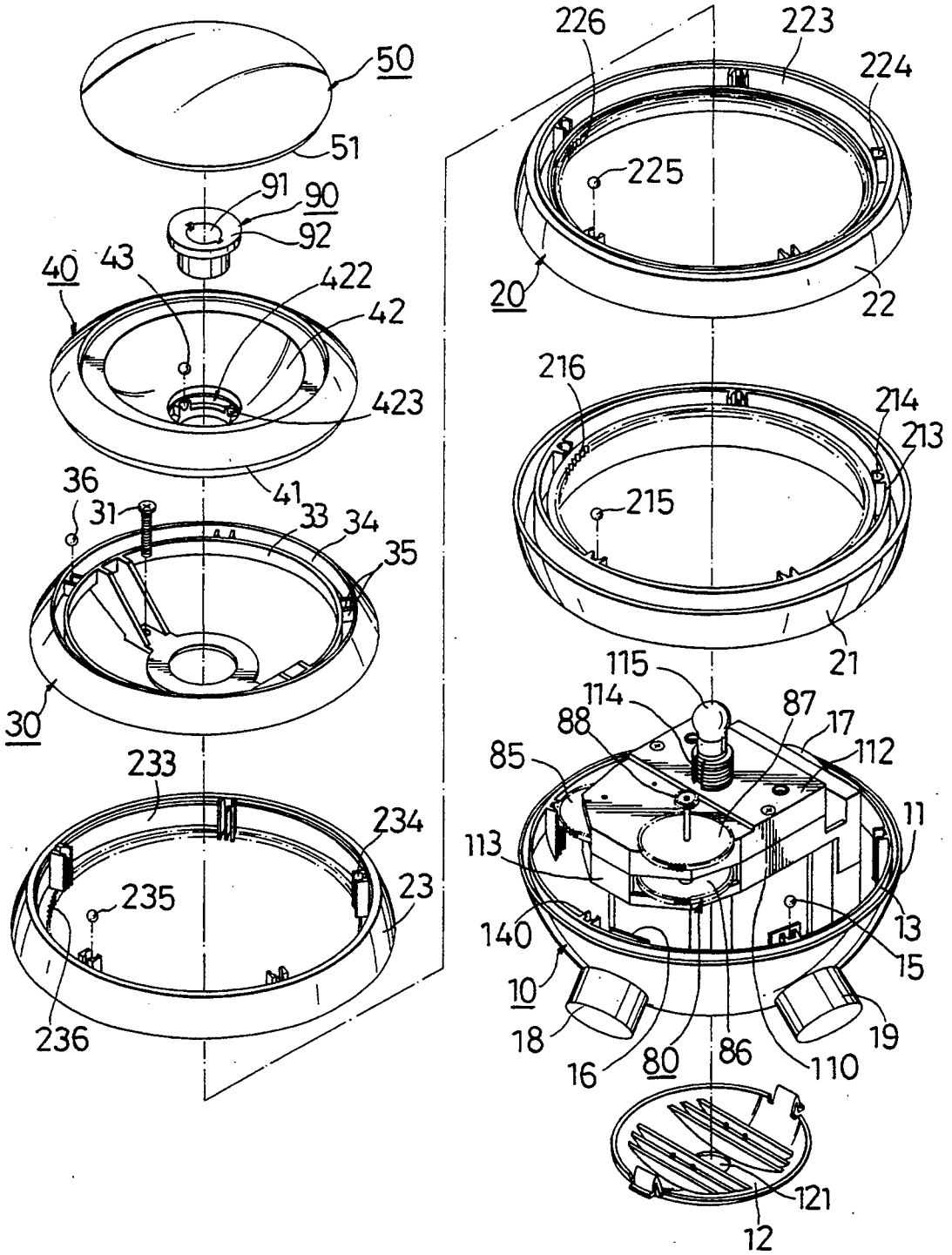
FIG. 3 is an exploded view illustrating a decoration according to this invention.
Figure 4:
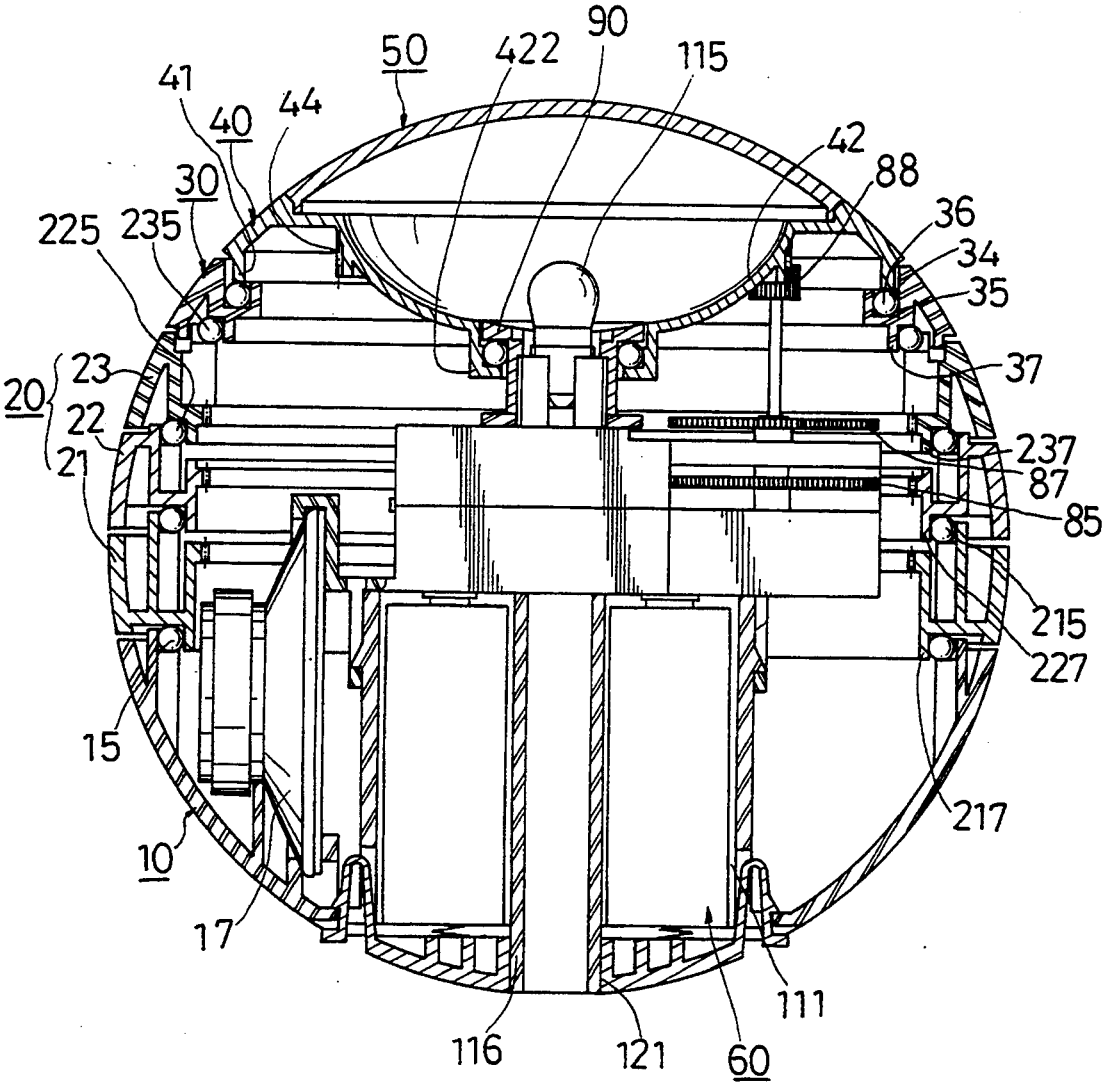
FIG. 4 is a sectional view of the decoration according to this invention.
Figure 5:
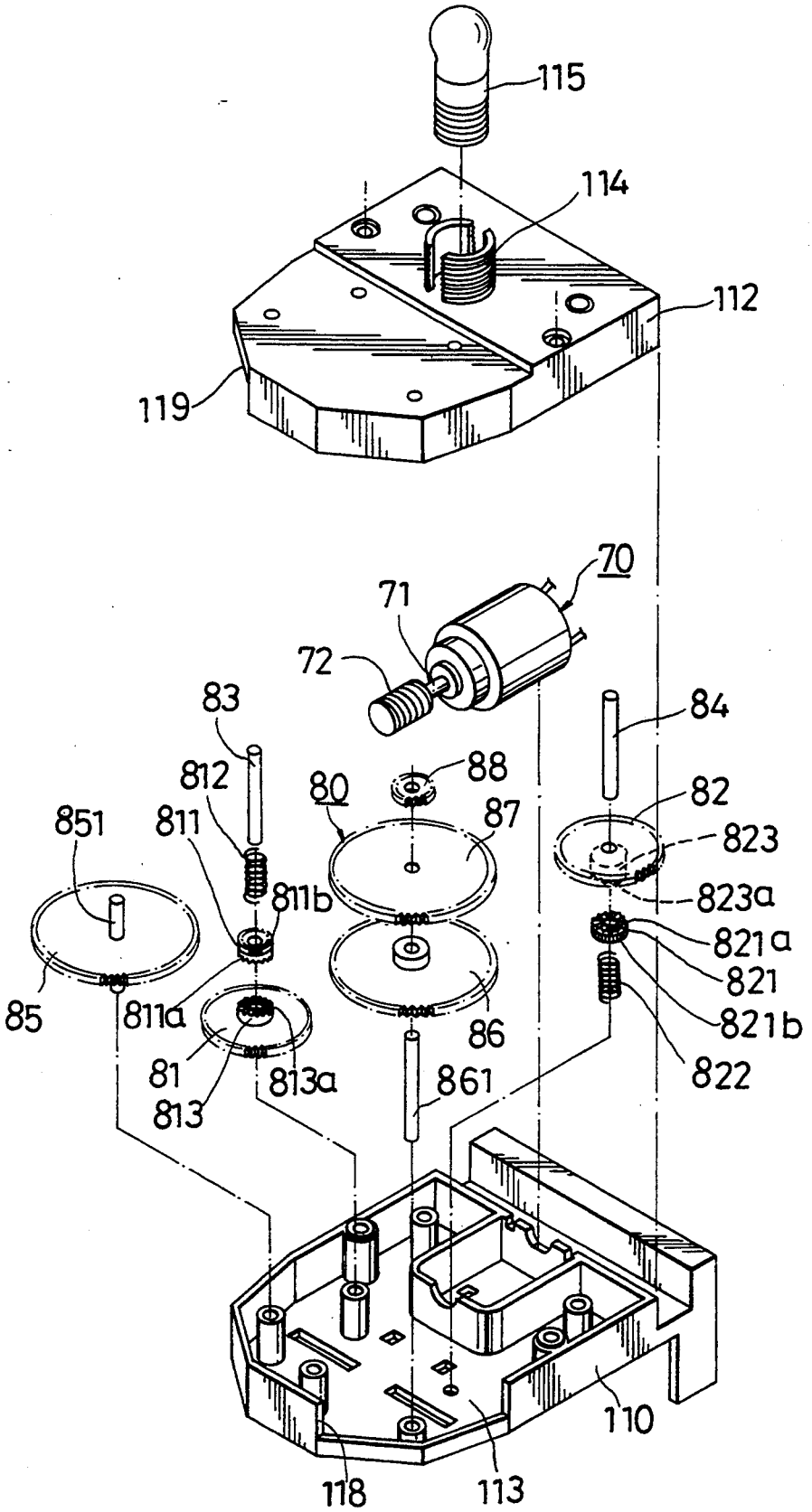
FIG. 5 is a partially exploded view of the decoration according to this invention.

Referring to FIGS. 3 to 5, a decoration of this invention includes a hollow base assembly 10 consisting of a base 11 and a bottom cover 12 which closes the bottom opening of the base 11, a first intermediate rotary ring 21, a second intermediate rotary ring 22, a third intermediate rotary ring 23, a mounting ring 30, an upper rotary ring 40 and a top cover 50. The intermediate rotary rings 21, 22 and 23 constitute an intermediate rotary ring assembly 20. The base assembly 10 is equipped thereon with a housing 110 (see FIG. 5), a light generating unit having a bulb seat 114 for a bulb 115, and a sound generating unit which consists of a music chip 16 (see FIG. 3) and a microphone 17. A battery chamber 111 is formed in the base assembly 10 so as to receive a pair of dry batteries 60. As best shown in FIG. 5, the housing 110 has an upper half 112, a lower half 113, and two openings 118, 119 which are defined between the upper and lower halves 112 and 113 . A driving device includes a motor 70 (see FIG. 5) having a motor shaft 71 and a worm 72 secured coaxially to the motor shaft 71. Two rotary knobs 18 and 19 ( see FIG. 3 ) are installed on the base 11 so as to control motion of the motor 70, the music chip 16 and the light generating unit.

As best shown in FIG. 5, a gearing 80 is disposed within the housing 110 and includes a left gear unit and a right gear unit. The left gear unit includes a left worm gear 81 mounted rotatably on the lower half 113 of the housing 110 and meshing with the worm 72, a lower ratchet wheel 813 secured coaxially to the top surface of the left worm gear 81, and an upper ratchet wheel 811 which has ratchet teeth **811*a* engaging the ratchet teeth 813*a* of the lower ratchet wheel 813, and an externally geared peripheral surface 811*b*. A vertical left rotating shaft 83 is journalled between the upper half 112 and the lower half 113 of the housing 110, and extends through a coiled spring 812, the upper ratchet wheel 811 and the left worm gear 81. The spring 812 biases the upper ratchet wheel 811 to engage the lower ratchet wheel 813**.

Figure 9:
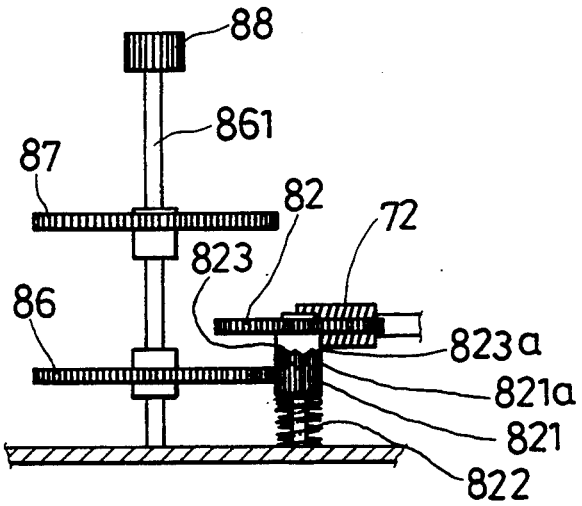
FIG. 9 is a schematic view illustrating a portion of the gearing of the decoration according to this invention.

Similarly, as shown in FIGS. 5 and 9, the right gear unit of the gearing 80 includes a right worm gear 82 mounted rotatably on the lower half 113 of the housing 110 and meshing with the worm 72, an upper ratchet wheel 823 secured coaxially to the bottom surface of the right worm gear 83, and a lower ratchet wheel 821 which has ratchet teeth **821*a* engaging the ratchet teeth 823*a* of the upper ratchet wheel 813, and a spur gear 821*b* secured coaxially to the upper ratchet externally geared peripheral surface 811. A vertical right rotating shaft 84 is journalled between the upper half 112 and the lower half 113 of the housing 110, and extends through the worm gear 82, the upper ratchet wheel 823, the lower ratchet wheel 821*b* and a coiled spring 822. The spring 822 biases the lower ratchet wheel 821 to engage with the upper ratchet wheel 823. Accordingly, the motor 70 can drive the gearing 80**.

As illustrated, a right driving shaft 861 is also journalled on the housing 110. A lower planetary gear 86 is secured to the lower portion of the shaft 861 and engages the externally geared peripheral surface **821*b* of the lower ratchet wheel 821. A middle planetary gear 87 and an upper planetary gear 88 are respectively secured to the middle and upper portions of the shaft 861. Another planetary gear 85 is secured to a left driving shaft 851 which is journalled on the housing 110 and which is located below the middle planetary gear 87 and above the lower planetary gear 96**.

Figure 8:
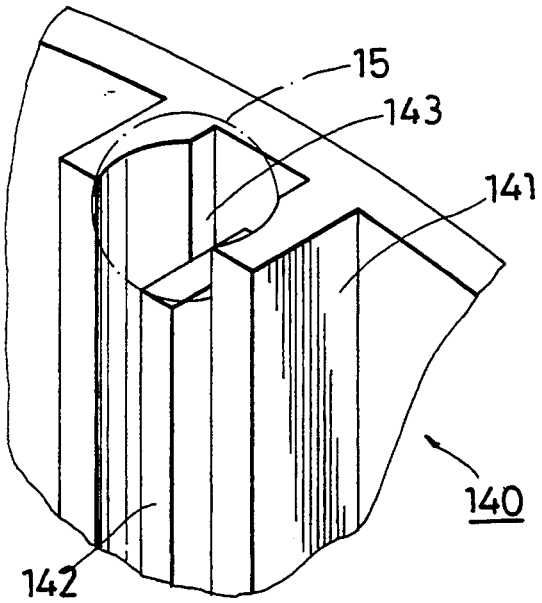
FIG. 8 is an enlarged view showing a ball accommodating space of the decoration according to this invention.

Again referring to FIG. 3, an upper bearing device is disposed on the upper end portion of the base 11 and includes a circular upward flange 13 projecting upward from the base 11, several circumferentially spaced-apart ball positioning units 140 (see FIG. 8) disposed along the flange 13, and several balls 15 (see FIG. 4) respectively positioned within the ball positioning units 140. Only one of the balls 15 is shown in FIG. 3 for clarity. As best shown in FIG. 8, each of the ball positioning units 140 includes two aligned vertical side ribs 141 and a vertical middle rib 142 which are parallel with each other and which project generally radially from the inner surface of the flange 13 in such a manner that the middle rib 142 is located between the side ribs 141. The side ribs 141 have top ends which are at the same level and which are above the top end of the middle rib 142 so as to define a ball accommodating space 143 between the side ribs 141 and above the middle rib 142, thereby resting one of the balls 15 (as indicated by the phantom lines) on the upper end of the middle rib 142.

Figure 7:
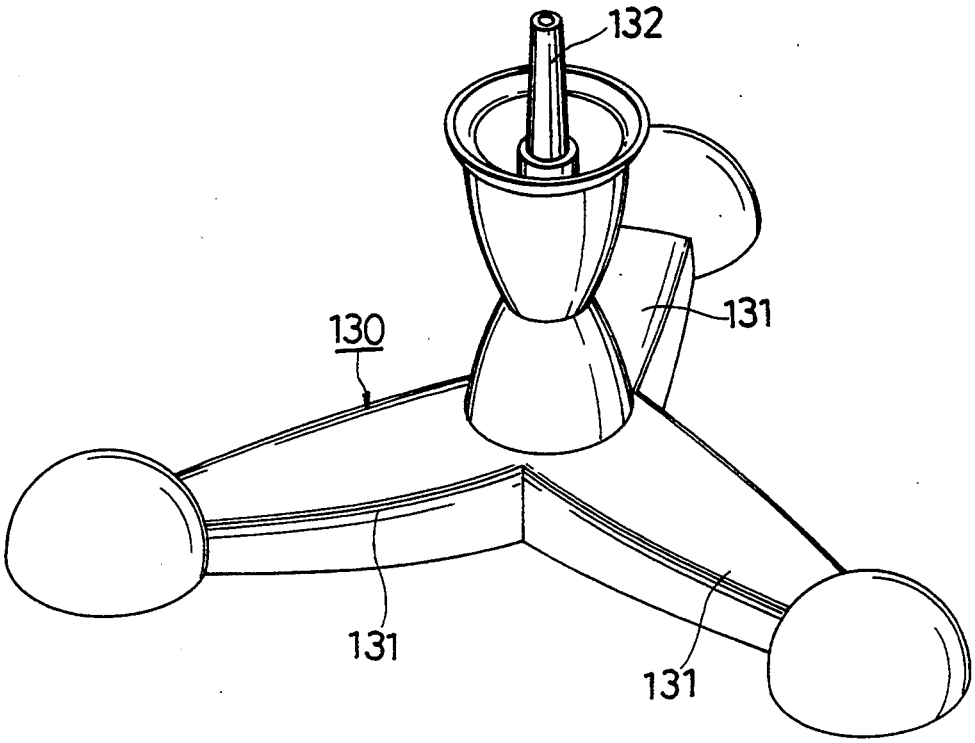
FIG. 7 is a perspective view illustrating the base support of the decoration according to this invention.

Again referring to FIG. 4, the base 11 further includes a circular tube 116 which is secured in the battery chamber 111 and which extends through the central hole 121 of the bottom cover 120. Accordingly, the base assembly 10 can be supported on a base support 130 (see FIG. 7) provided with three legs 131 (see FIG. 7), in such a manner that the top tongue 132 (see FIG. 7) of the base support 130 is inserted into the circular tube 116 of the base assembly.

Again referring to FIG. 3, the mounting ring 30 is secured to the base 11 by two lock bolts 31 (only one is shown). The three intermediate rotary rings 21, 22 and 23 are superposed between the base 11 and the mounting ring 30. The upper rotary ring 40 is disposed on the mounting ring 30. The top cover 50 has a curved projection 51 which is fitted within the upper end cavity of the upper rotary ring 40 so as to close the open upper end of the upper rotary ring 40. A mushroom-shaped sleeve 90 is interposed between the upper rotary ring 40 and the top cover 50 and has a central bore 91 and an upper outward flange 92. The bulb 115 extends through the sleeve 90.

Each of the intermediate rotary rings 21, 22 and 23, the mounting ring 30 and the upper rotary ring 40 has an upper bearing device disposed at the upper end portion thereof, and a lower bearing device disposed at the lower end portion thereof, which are described hereinafter.

Each of the upper bearing devices of the intermediate rotary rings 21, 22 and 23 is constructed in the same manner as that of the base 11 and includes a circular upward flange 213, 223, 233, several ball positioning units 214, 224, 234, and several balls 215, 225, 235 (only one is shown).

Each of the lower bearing devices of the intermediate rotary rings 21, 22 and 23 and the mounting ring 30 includes a circular downward flange 217, 227, 237, 37 (see FIG. 4) projecting downward therefrom so as to confine the balls 15, 215, 225, 235 between the downward flange 217, 227, 237, 37 and the upward flange 13, 213, 223, 233 thus positioning the balls 15, 215, 225, 235 on the ball positioning units 140, 214, 224, 234. All of the upward flanges 13, 213, 223, 233, 217, 227, 237 and 37 are coaxial.

The upper bearing device of the mounting ring 30 includes a circular upward flange 33 projecting upward therefrom, an auxiliary circular flange 34 projecting upward from the mounting ring 30 outside the upward flange 33, several ball positioning units disposed along the upward flange 33, and several balls 36. The auxiliary circular flange 34 is coaxial with the upward flange 33. Each of the ball positioning units of the mounting ring 30 includes two generally radially extending parallel ribs 35 which interconnect the upward flange 33 and the auxiliary circular flange 34 so as to confine the corresponding ball 36 therebetween.

The lower bearing device of the upper rotary ring 40 includes a circular downward flange 41 (see FIG. 4) located between the upward flange 33 and the auxiliary circular flange 34 and over the balls 36 so as to prevent removal of the balls 36 from the ball positioning units of the mounting ring 30.

The upper bearing device of the upper rotary ring 40 includes an inward flange 422 which is formed with several ball positioning units 423. As illustrated, each of the ball positioning units 423 includes a post projecting upward from the inner periphery of the flange 422 and having an upper end portion which has a recess within which a ball 43 is placed. As best shown in FIG. 4, the balls 43 are confined between the sleeve 90 and the ball positioning units 423 in such a manner that the large-diameter portion or outward flange 92 of the sleeve 90 can prevent the balls 43 from upward movement of the balls 43 relative to the inward flange 422, and that the small-diameter portion of the sleeve 90 can prevent the balls 43 from radial inward movement of the balls 43 relative to the inward flange 422. Each of the upper rotary ring 40, the intermediate rotary rings 21, 22 and 23 is formed on the inner surface thereof with an internal gear 44, 216, 226, 236 (see FIG. 4).

Referring to FIGS. 4 and 5, the planetary gears 86, 85, 87 and 88 of the gearing 80 are horizontal and are respectively engaged with the internal gears 216, 226, 236 and 44 of the intermediate rotary rings 21, 22 and 23 and the upper rotary ring 40 so as to rotate the rotary rings 21, 22, 23 and 40 relative to the base 11 and the mounting ring 30.

It can be appreciated that the upper and lower bearing devices help relative rotation between any adjacent pair of the base 11, the intermediate rotary rings 21, 22 and 23, the mounting ring 30 and the upper rotary ring 40.

Figure 6:
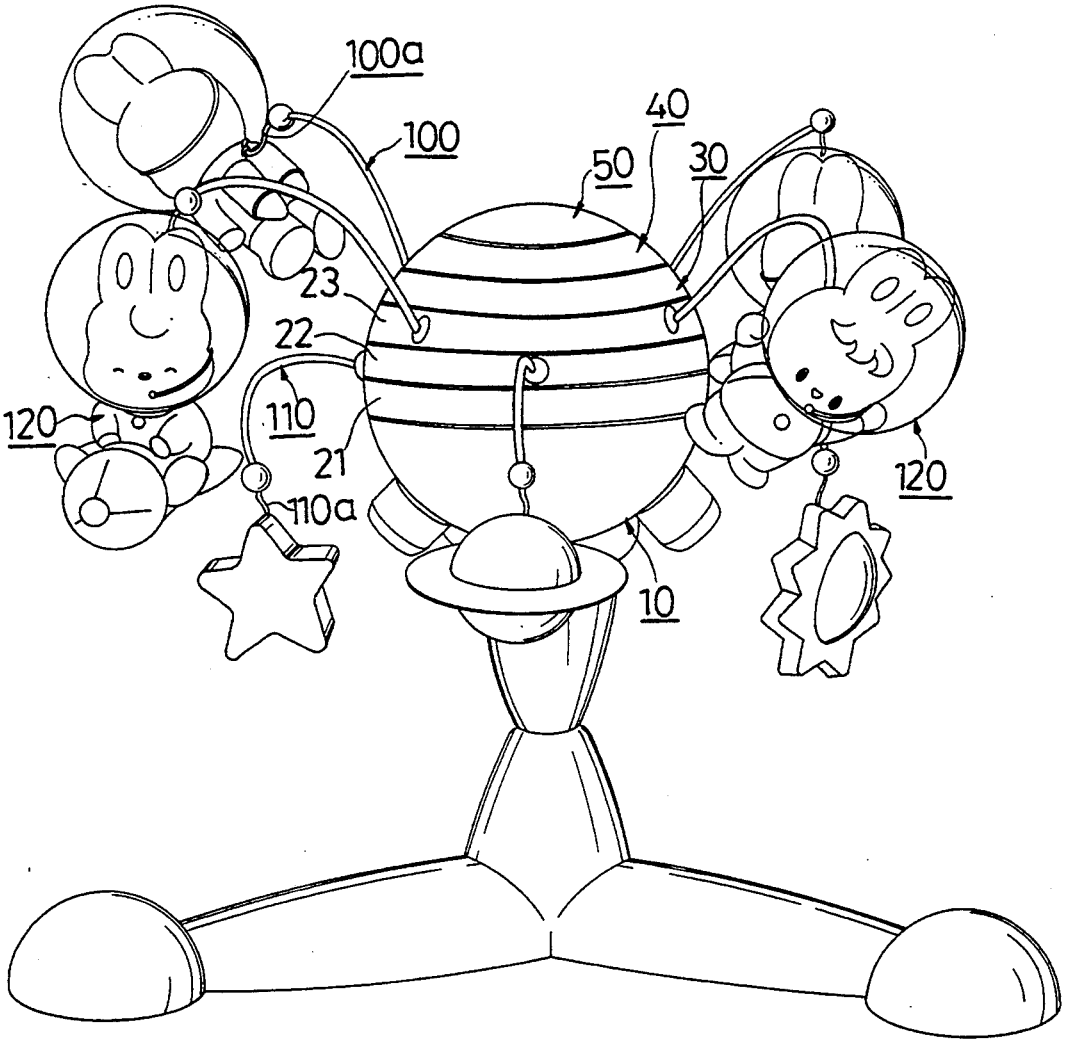
FIG. 6 is a schematic view illustrating the use of the decoration according to this invention.

As illustrated in FIG. 6, in use, several decorating articles 110*a*, 120 and 100*a* which are of different designs can be hung selectively on the circumferential surfaces of the rotary rings 21, 22, 23 and 40 by means of suspending strips 100. When the rotary rings 21, 22, 23 and 40 are rotated on the base 11, the decorating articles rotate at different speeds.

Again referring to FIGS. 5 and 9, as a safety precaution, with two pairs of the ratchet wheels 811 and 813, 821 and 823 interposed between the motor 70 and the planetary gears 85 and 86, excessive operating load of the motor 70 stops the rotation of the planetary gears 85 and 86 and the lower ratchet wheels 813 and 821 on the base 11 and permits the vertical movement of the lower ratchet wheels 812, 821 relative to the upper ratchet wheels 811, 823. Accordingly, when the motor 70 is running and when the operating load of the motor 70 exceeds a predetermined limit and stops the rotation of the planetary gears 85, 86, the ratchet teeth 811*a*, 823*a* of the upper ratchet wheels 811, 823 urge the lower ratchet wheels 812, 821 downward so as to disengage the lower ratchet wheels 812, 821 from the upper ratchet wheels 811, 823, thereby avoiding malfunction of the decoration.

With this invention thus explained, it is apparent that numerous modifications and variations can be made without departing from the scope and spirit of this invention. It is therefore intended that this invention be limited only as indicated in the appended claims.

I claim:

1. A decoration comprising:

a hollow base assembly equipped thereon with a bulb seat, a sound generating unit, and a motor, said bulb seat being disposed on a top end portion of said base assembly and being adapted to be mounted with a bulb thereon so as to generate light, said base assembly further including a battery chamber formed therein and adapted to receive a battery therein so as to activate said motor, a base having a bottom opening formed in a bottom end portion thereof, a bottom cover mounted removably on said base so as to close said bottom opening, and an upper bearing device disposed on an upper end portion of said base, said bottom cover being removable from said base so as to permit entry of the battery into said battery chamber;

a mounting ring fixed on and located above said base and having an upper bearing device disposed on an upper end portion of said mounting ring, and a lower bearing device disposed on a lower end portion of said mounting ring;

several superposed intermediate rotary rings interposed between said base and said mounting ring, each of said intermediate rotary rings including an upper bearing device disposed on an upper end portion of said intermediate rotary ring, and a lower bearing device disposed on a lower end portion of said intermediate rotary ring;

an upper rotary ring mounted rotatably and coaxially on and above said mounting ring and including a lower bearing device disposed on a lower end portion of said upper rotary ring;

a light permeable transparent top cover resting on an upper end portion of said upper rotary ring so as to close an open top end of said upper rotary ring, said top cover being removable from said upper rotary ring so as to permit the bulb to pass through said upper rotary ring, said mounting ring and said intermediate rotary rings, when mounting the bulb on said bulb seat;

a gearing including several horizontal planetary gears which are disposed rotatably on said base and which are rotatable by said motor;

each of said upper and intermediate rotary rings including an internal gear which is formed on an inner surface thereof and which meshes with one of said planetary gears of said gearing;

any adjacent two of said upper rotary ring, said mounting ring, said intermediate rotary rings and said base being interconnected rotatably by association of one of said upper bearing devices with one of said lower bearing devices, each of said upper bearing devices and an associated one of said lower bearing devices together constituting a bearing mechanism so as to facilitate relative rotation of any adjacent two of said upper rotary ring, said mounting ring, said intermediate rotary rings and said base;

said upper bearing device of each of said mounting ring, said intermediate rotary rings and said base including a circular upward flange projecting upward from a periphery thereof, several circumferentially spaced-apart ball positioning units disposed along said circular upward flange, and several balls respectively positioned within said ball positioning units; and said lower bearing device of each of said upper rotary ring, said mounting ring and said intermediate rotary rings including a circular downward flange which projects downward from a periphery thereof and which rests on and above a top end portion of a corresponding one of said mounting ring, said intermediate rotary rings and said base so that, in each of said bearing mechanisms, said balls being confined between said circular downward flange and said ball positioning units so as to facilitate relative rotation between any adjacent two of said upper rotary ring, said mounting ring, said intermediate rotary rings and said base, all of said circular upward and downward flanges being coaxial;

whereby, when said motor is powered, said upper rotary ring and said intermediate rotary rings rotate relative to said base assembly and said mounting ring.

2. A decoration as claimed in claim 1, wherein each of said positioning units of said intermediate rotary rings and said base includes two aligned vertical side ribs and a vertical middle rib which are parallel with each other and which project generally radially from an inner surface of said circular upward flange in such a manner that said middle rib is located between said side ribs, said side ribs having top ends which are at the same level and which are above a top end of said middle rib so as to define a ball accommodating space between said side ribs of each of said positioning units of said intermediate rotary rings and said base and above a corresponding said middle rib, thereby resting said balls on said middle ribs of said positioning units, each of said circular downward flanges of said mounting ring and said intermediate rotary rings being located inside a corresponding one of said circular upward flanges of said upper bearing devices in such a manner that said side and middle ribs of a corresponding one of said ball positioning units are located between said circular downward flange and said circular upward flange of a corresponding one of said bearing mechanisms.

3. A decoration as claimed in claim 2, wherein each of said side ribs of said positioning units has a curved inner surface so as to confine each of said balls between said curved inner surfaces of said side ribs of a corresponding one of said ball positioning units.

4. A decoration as claimed in claim 1, wherein said mounting ring further includes an auxiliary circular flange which projects upward therefrom and which is radially spaced apart from and coaxial with said circular upward flange of said mounting ring, each of said ball positioning units of said mounting ring including two generally radially extending parallel ribs which are spaced apart from each other so as to confine a corresponding one of said balls therebetween and which are between said circular upward flange and said auxiliary circular flange of said mounting ring, said circular downward flange of said upper rotary ring having a bottom end which is located intermediately over said balls of said upper bearing device of said mounting ring so as to prevent removal of said balls of said upper bearing device of said mounting ring from said ball positioning units of said mounting ring.

5. A decoration as claimed in claim 1, wherein said gearing further comprising means for automatically disengaging said motor when operating load of said motor, exceeds a predetermined limit.

* * * * *